US008989642B2

(12) United States Patent
Usui

(10) Patent No.: US 8,989,642 B2
(45) Date of Patent: Mar. 24, 2015

(54) FIXING DEVICE PREVENTABLE UNEVENNESS OF HEAT GENERATION OF PAPER PASSING REGION

(71) Applicant: KYOCERA Document Solutions Inc., Osaka (JP)

(72) Inventor: Shogo Usui, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/066,368

(22) Filed: Oct. 29, 2013

(65) Prior Publication Data

US 2014/0119785 A1 May 1, 2014

(30) Foreign Application Priority Data

Oct. 30, 2012 (JP) ..... 2012-239406

(51) Int. Cl.
*G03G 15/20* (2006.01)

(52) U.S. Cl.
CPC ..... *G03G 15/2053* (2013.01); *G03G 15/2042* (2013.01)
USPC ..... 399/328

(58) Field of Classification Search
CPC ..... G03G 15/2053; G03G 15/2042
USPC ..... 399/328, 334
See application file for complete search history.

(56) References Cited

U.S. PATENT DOCUMENTS

| | | | | |
|---|---|---|---|---|
| 2002/0048472 | A1 | 4/2002 | Samei | 399/328 |
| 2002/0054775 | A1 * | 5/2002 | Takagi et al. | 399/330 |
| 2008/0181642 | A1 * | 7/2008 | Kishi | 399/69 |

FOREIGN PATENT DOCUMENTS

| | | | |
|---|---|---|---|
| JP | 9-26719 | A | 1/1997 |
| JP | 2002-123106 | A | 4/2002 |

* cited by examiner

*Primary Examiner* — Ryan Walsh
(74) *Attorney, Agent, or Firm* — Stein IP, LLC

(57) ABSTRACT

A fixing device includes a heating member, a pressing member, and an induction heating unit. In this fixing device, (i) a wound width Wc of a center portion of an induction heating coil in a longitudinal direction seen from an axial direction of the heating member, (ii) a wound width Wp in the vicinity of and inside edges of a maximum recording medium passing region of a recoding medium, and (iii) a wound width We of at least one of both edges of the induction heating coil in the longitudinal direction satisfy parameters that the wound width Wc is smaller than the wound width Wp and is larger than or equal to the wound width We.

14 Claims, 9 Drawing Sheets

FIXING DEVICE PREVENTABLE UNEVENNESS OF HEAT GENERATION OF PAPER PASSING REGION

CROSS-REFERENCE TO RELATED APPLICATIONS

This application is based upon, and claims the benefit of priority from, corresponding Japanese Patent Application No. 2012-239406 filed in the Japan Patent Office on Oct. 30, 2012, the entire contents of which are incorporated herein by reference.

BACKGROUND OF THE INVENTION

Field of the Invention

Unless otherwise indicated herein, the description in this section is not prior art to the claims in this application and is not admitted to be prior art by inclusion in this section.

In some image forming apparatuses using an electrophotographic system, a heat roller fixing formula is used for fixing a toner image to paper. In the heat roller fixing system, the toner image is fixed on the paper by inserting a paper (recording medium) carrying a toner image into a nip formed between a pair of fixing rollers, and heating and pressurizing the recording medium using a heat roller provided by installing a heat source in at least one roller of the pair of fixing rollers or outside the rollers.

Also, a belt fixing system is developed which is configured to fix a toner image to a recording medium by using an endless fixing belt heated by a heat source instead of a heat roller and then passing the recording medium carrying the un-fixed toner image through a nip portion formed between the fixing belt and a pressing member pressed to the fixing belt. This belt fixing system may lower thermal capacity as compared to that in the heat roller fixing system, which may shorten a warm-up time and reduce power consumption.

As a heating system for heating the heating roller and the fixing belt, for example, some fixing devices employ a lamp heating system heating with lamps such as halogen bulbs. In recent years, an induction heating (IH) system has been proposed. The fixing device employing the induction heating formula is so designed that an alternating magnetic field intersects a magnetic conductive member, to generate an eddy current.

The fixing device employing the induction heating unit is applied with a high frequency current to the induction heating coil on which a Litz wire is wound along an outer circumferential surface of a bobbin extending in a width direction of the heating member such as the heating roller or the fixing belt (that is, an orthogonal direction to the paper conveying direction), thereby generating a high frequency magnetic flux. This high frequency magnetic flux works on an induction heating layer of the heating roller or the fixing belt. Then, the eddy current is generated around the magnetic flux in the induction heating layer. Thus, Joule heat is generated due to a specific resistance of the material of the induction heating layer, to heat the heating roller or the fixing belt.

In the case where the fixing device employing the induction heating unit is so configured that a length of the induction heating coil in the longitudinal direction is substantially equal to a length of the heating roller in the longitudinal direction or a width of the fixing belt in the width direction, turn portions (or turn up portions) of the induction heating coil are opposite to the longitudinal direction ends of the heating roller or the width direction ends of the fixing belt. In the above fixing device employing the induction heating unit, magnetic flux generated in the turn portions are less than the magnetic flux generated in portions other than the turn portions, such as linear portions. Therefore, both end portions of the heating roller in the longitudinal direction opposite to the turn portions or both ends of the fixing belt in the width direction, may not be effectively heated. This may cause unevenness in the fixing temperature and/or energy loss.

This problem seems possible to solve when the linear portion of the induction heating coil is so designed to be longer than the length in the longitudinal direction of the heating roller or the length in the width direction of the fixing belt. However, this may cause the induction heating unit including the induction heating coil to enlarge, thereby being an obstacle to downsizing the image forming apparatus.

Thus, fixing devices are proposed which can effectively use magnetic flux generated in the induction heating coil without enlarging the image forming apparatus. For example, one proposed induction heating unit is designed so that a distance between a magnetizing coil and a fixing film as the heating member is closer in both end portions in the width direction of the fixing film than the distance in a center portion to increase an amount of heat generation in both end portions in the width direction of the fixing film. And, for example, another proposed fixing device employing the induction heating unit is so designed that a cross section of a core member, on which a magnetizing coil is wound, is broader from the center portion to the both end portions in the longitudinal direction of the heating roller, to increase the interval of the magnetizing coil from the center portion to both end portions in the longitudinal direction of the heating roller.

SUMMARY OF THE INVENTION

Additional aspects and/or advantages of the invention will be set forth in part in the description which follows and, in part, will be obvious from the description, or may be learned by practice of the invention.

A fixing device according to an aspect of the present disclosure includes a heating member, a pressing member, and an induction heating unit. The pressing member may be configured to contact the heating member and to form a nip portion. The induction heating unit may be configured to generate a magnetic flux by applying an electric current to an induction heating coil arranged along an outer circumferential surface of the heating member to heat an induction heating layer provided on the heating member. In this fixing device, (i) a wound width Wc of a center portion of the induction heating coil in a longitudinal direction seen from an axial direction of the heating member, (ii) a wound width Wp in the vicinity of and inside edges of a maximum paper passing region of a recording medium, and (iii) a wound width We of at least one of both edges of the induction heating coil in the longitudinal direction satisfy the parameters that the wound width Wc is smaller than the wound width Wp and is larger than or equal to the wound width We.

An image forming apparatus according to another aspect of the present disclosure includes the above mentioned fixing device and an image forming unit.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
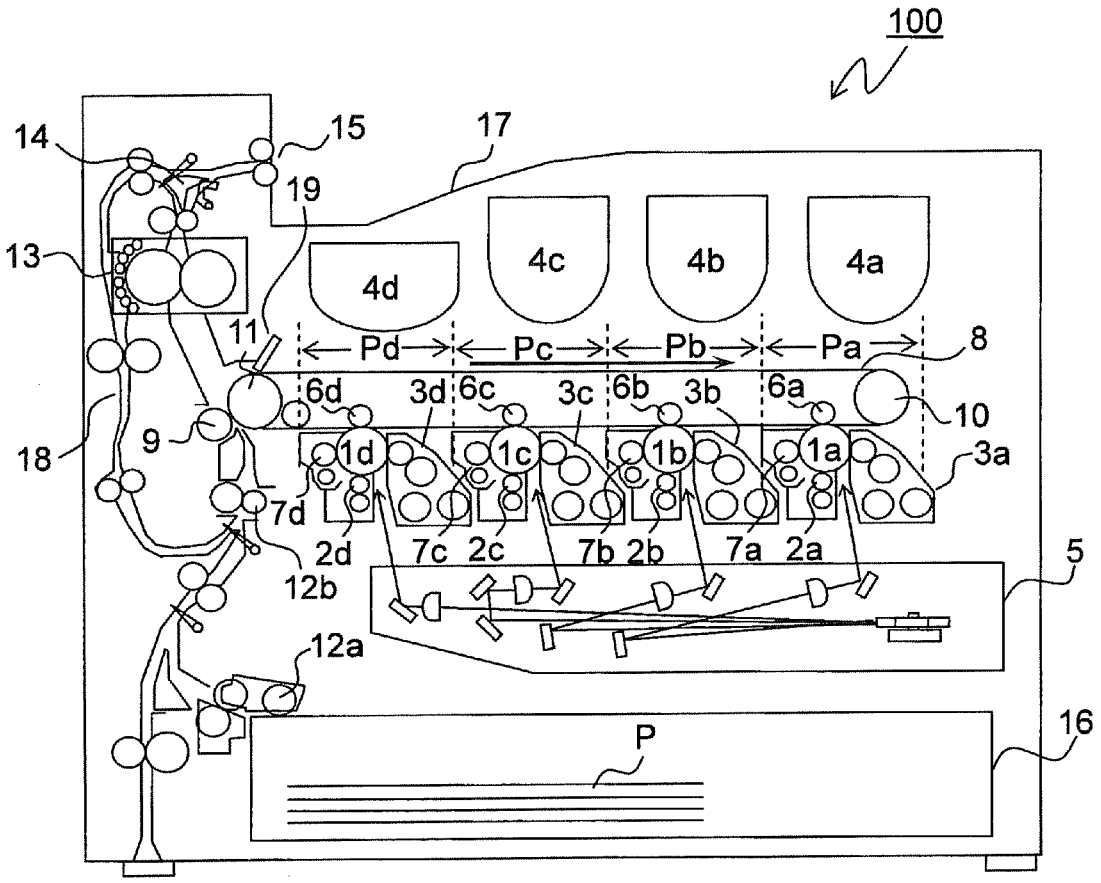
FIG. 1 is a schematic cross-sectional view of a color printer provided with a fixing device according to an exemplary embodiment of the present disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

An exemplary embodiment according to the present disclosure is described hereafter referring to the accompanying drawings. FIG. 1 is a schematic cross-sectional view of a color printer 100 provided with a fixing device 13 according to one of exemplary embodiments of the present disclosure. FIG. 1 shows a color image forming apparatus employing a tandem unit as the color printer 100. Four image forming sections Pa, Pb, Pc and Pd are provided in a main body of the color printer 100 sequentially from upstream (right side in FIG. 1) in a moving direction of an intermediate transfer belt 8. These image forming sections Pa to Pd are provided for four different color images (magenta, cyan, yellow, and black), respectively. And these image forming section Pa to Pd form a magenta image, a cyan image, a yellow image, and a black image through an electrostatic charging process, an exposure process, a developing process, and a transferring process, respectively.

These image forming sections Pa to Pd are provided with photoconductor drums 1*a*, 1*b*, 1*c*, and 1*d* bearing the above four color visible images (toner images) respectively. The intermediate transfer belt 8 is provided adjacent to each of the image forming sections Pa to Pd and rotates clockwise in FIG. 1 by a drive mechanism (not shown.) Toner images formed on these photoconductor drums 1*a* to 1*d* are primarily transferred sequentially and then superposed on the intermediate transfer belt 8 moving while in contact with the photoconductor drums 1*a* to 1*d*. The superposed image is secondarily transferred to a paper P, which is just one example of a recording medium, by a secondary transfer roller 9. Then, the image is fixed to the paper P in the fixing device 13. Further, the paper P is discharged from the main body of the printer 100. An image forming process for each of the photoconductor drums 1*a* to 1*d* is performed while rotating the photoconductor drums 1*a* to 1*d* in a counterclockwise direction in FIG. 1.

Papers P on which toner images are transferred are stored in paper cassettes 16 provided in a lower portion of the main body of the color printer 100. Each paper P is conveyed to a nip portion between the secondary transfer roller 9 and a drive roller 11 disposed in an interior of the intermediate transfer belt 8 described below through a sheet supply roller 12*a* and a registration roller pair 12*b*. The intermediate transfer belt 8 may employ a sheet made from dielectric resin. Also, the intermediate transfer belt 8 may be, for example, a seamless belt, that is, one which has no joint line. A belt cleaner 19 is provided downstream in the moving direction of the intermediate transfer belt 8 seen from a side of the second transfer roller 9, to remove remains such as toners that are left on a surface of the intermediate transfer belt 8.

The image forming units Pa to Pd are described hereinafter. Around and below the photoconductor drums 1*a* to 1*d*, charging members 2*a*, 2*b*, 2*c*, and 2*d* configured to charge the photoconductor drums 1*a* to 1*d*, an exposure unit 5 configured to irradiate light to expose images based on image information on each of photoconductor drums 1*a* to 1*d*, developing units 3*a*, 3*b*, 3*c*, and 3*d* configured to form toner image on the photoconductor drums 1*a* to 1*d*, and cleaning units 7*a*, 7*b*, 7*c*, and 7*d* configured to remove remaining developers (toner) from the photoconductor drums 1*a* to 1*d*, are respectively provided.

When image data is input from external devices such as personal computers (PCs), then, surfaces of the photoconductor drums 1*a* to 1*d* are uniformly charged by the charging members 2*a* to 2*d*. Then, the exposure unit 5 irradiates light to the photoconductor drums 1*a* to 1*d* based on image data, to form an electrostatic latent image on the photoconductor drums 1*a* to 1*d*. The developing units 3*a* to 3*d* are provided with two component developers including toners in magenta, cyan, yellow, and black colors, respectively. When toner images (described below) are formed and the amount of toners included in the two component developers filled in each of the developing units 3*a* to 3*d* gets less than a predetermined value, the toners are supplied from toner containers 4*a* to 4*d* to the developing devices 3*a* to 3*d*, respectively. These toners included in the developers are supplied and thereby electrostatically attached to the photoconductor drums 1*a* to 1*d* via the developing devices 3*a* to 3*d*, which form toner images corresponding to electrostatic latent images via exposure from the exposure unit 5.

Then, first transferring rollers 6*a* to 6*d* apply an electric field at a predetermined transferring voltage between the first transferring rollers 6*a* to 6*d* and the photoconductor drums 1*a* to 1*d* respectively. This may transfer the magenta, cyan, yellow, and black toner images onto the intermediate transferring belt 8 in order. These four color images are formed in a predetermined positional relationship for the purpose of forming a predetermined full color image. Then, for a sequential forming of a new electrostatic latent image, residues such as toners remaining on the surface of the photoconductor drums 1*a* to 1*d* are removed by the cleaning portions 7*a* to 7*d*.

The intermediate transfer belt 8 is wound between a driven roller 10 provided upstream and the drive roller 11 provided downstream in a rotating direction of the intermediate transfer belt 8. The intermediate transfer belt 8 starts rotating clockwise with a rotation of the drive roller 11 driven by a drive motor (not shown). Then the paper P is conveyed from a pair of registration roller 12*b* to a nip portion formed between the drive roller 11 and the secondary transfer roller 9 provided adjacent thereto (hereinafter called also as a secondary transfer nip portion). And a full-color image on the intermediate transfer belt 8 is transferred onto the paper P. The paper P on which the toner image is transferred is conveyed to the fixing device 13.

Figure 2:
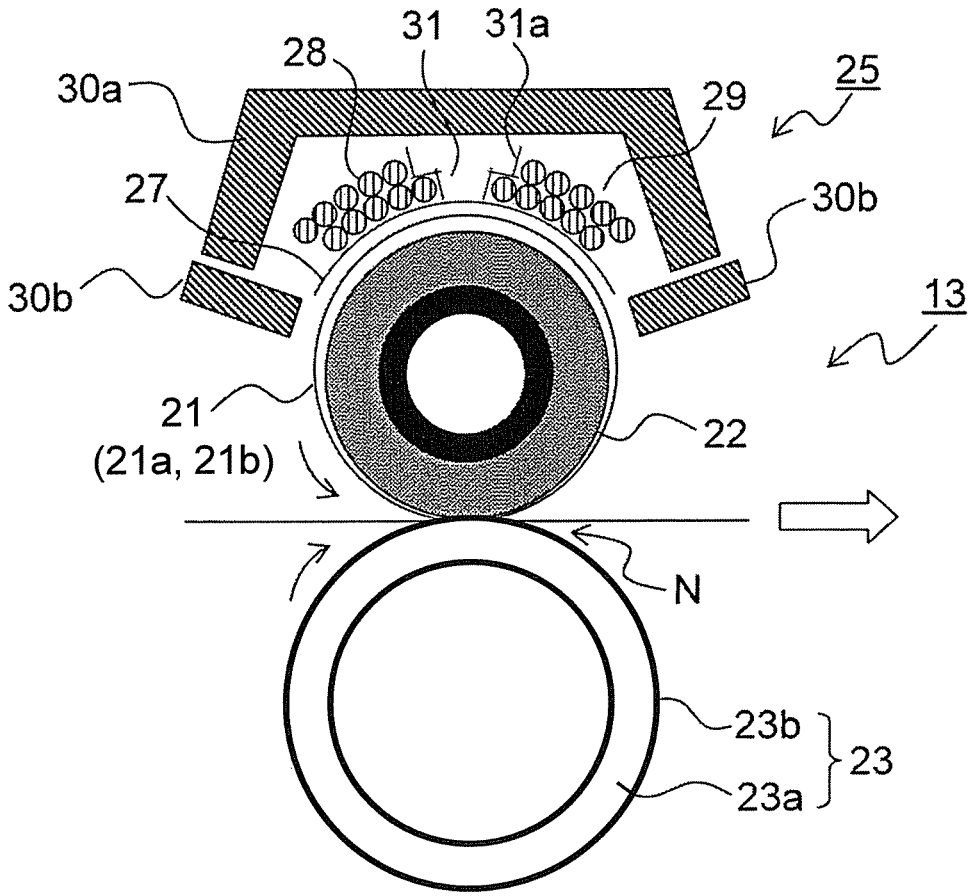
FIG. 2 is a sectional side view of the fixing device according to one of exemplary embodiments of the present disclosure.

The paper P conveyed to the fixing device 13 is heated and pressurized with a heating belt 21 and a pressure roller 23 (referring to FIG. 2). This fixes the toner image onto a surface of the paper P to form a predetermined full color image. The conveying direction of the paper P with the full color image is selectively determined with a separating portion 14 having a plurality of separating directions. When the image is formed on only one side of the paper P, a discharging roller pair 15 discharges the paper P to a discharging tray 17.

On the other hand, when the image is formed on both sides of the paper P, the paper P passing through the fixing device 13 is conveyed to the discharging roller pair 15 once. After a rear end of the paper P passes through the separating portion 14, the discharging roller pair 15 rotates reversely to change a conveying direction in the separating portion 14. Then the paper P is directed to a reverse conveying path 18 from the rear end of the paper P. The paper P is conveyed to the secondary transfer nip portion again with the image formed side reversed. A next image formed on the intermediate transfer belt 8 is transferred onto the side with no image of the paper P via the secondary transfer roller 9. Then the paper P is conveyed to the fixing device 13 to fix the toner image, being discharged via the discharging roller pair 15 to the discharging tray 17.

Figure 3:
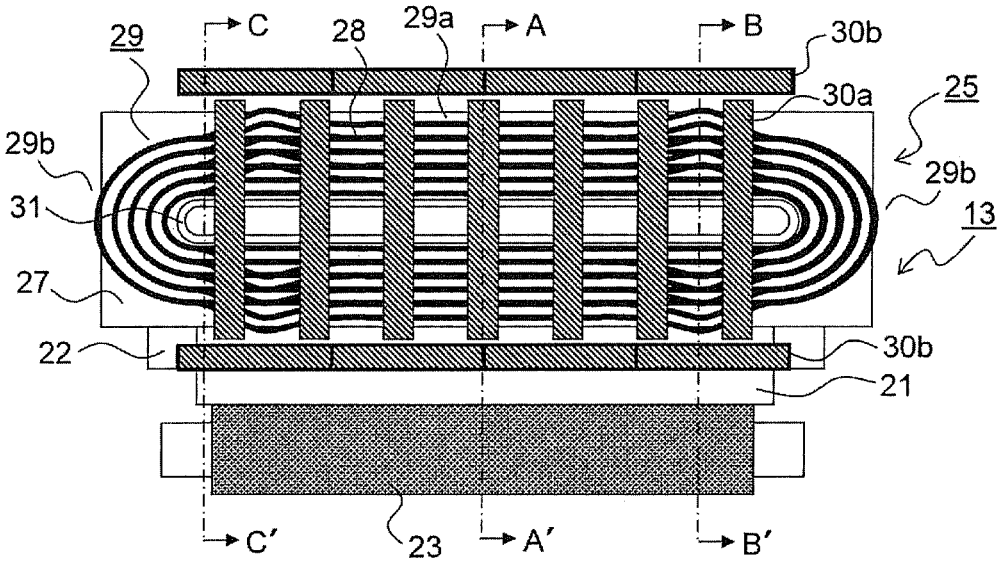
FIG. 3 is a plane view of the fixing device seen from an induction heating portion side.

FIG. 2 is a sectional side view of the fixing device 13 (a sectional view taken along arrows AA' of FIG. 3) and FIG. 3 is a plane view of the fixing device 13 seen from an induction heating portion 25 side (upper direction in FIG. 2). FIG. 2 shows the fixing device 13 illustrated in FIG. 1 in the turned state by 90 degrees in the clockwise direction. In FIG. 2, the paper is conveyed from left to right. And in FIG. 3, the heating belt 21 and the pressure roller 23 located in a back side of the induction heating portion 25 are illustrated as being appropriately shifted with respect to each other.

As shown in FIG. 2 and FIG. 3, the fixing device 13 includes the heating belt 21 constituted by an endless belt, a fixing roller 22 contacting an inner surface of the heating belt 21 and rotating in the counterclockwise direction in FIG. 2, the pressure roller 23 rotating in the clockwise direction in FIG. 2, and the induction heating portion 25 located on the opposite side of the pressure roller 23 and sandwiching the heating belt 21 therebetween. A pressure contact portion is formed between the heating belt 21 and the pressure roller 23 as a fixing nip portion N conveying the paper P with the toner image formed to heat and to pressurize the paper P.

The heating belt 21 is an endless belt with a plurality of laminated layers such as an induction heating layer 21*a* provided innermost and contacting the fixing roller 22 and a release layer 21*b* provided outermost and contacting the pressure roller 23. This heating belt 21 is wound around the fixing roller 22 and is given a predetermined tension, and a part of the heating belt 21 which does not contact the fixing roller 22 is maintained in an arc shape and disposed apart from the induction heating portion 25 with a predetermined interval. Instead of the fixing roller 22, a belt support member pressurized to the pressure roller 23 via the heating belt 21 may be provided.

The induction heating layer 21*a* of the heating belt 21 may employ a metal layer formed through plating metals such as nickel or a metal layer formed through a metal rolling. The release layer 21*b* may be formed using fluorinated resin such as PFA (tetrafluoroethylene-perfluoroalkyl vinyl ether copolymer) and applying the resin as paint or covering it as a tube. The release layer 21*b* may be preferably formed to a thickness of 10 to 50 μm when formed from PFA tube, and preferably formed to a thickness of 10 to 30 μm when formed from fluoropolymer paint.

Also, between the induction heating layer 21*a* and the release layer 21*b*, a silicone rubber layer formed to a thickness of about 0.1 to 1 mm may be provided as an elastic layer. In this configuration, in the nip portion N, the heating belt 21 can be more deformed to follow the shape of the circumferential surface of the pressure roller 23. Therefore, an unfixed toner image on the paper may be fixed softly. This may provide a high quality image. And a high performance fixing device can be obtained.

Also, a heat storage layer may be provided between the induction heating layer 21*a* and the release layer 21*b*. This heat storage layer may retain heat generated on the induction heating layer 21*a* and maintain a surface temperature of the heating belt 21 uniformly. This may also provide further high heating efficiency, shorten the warm-up time, and reduce the power consumption. When both the elastic layer and the heat storage layer may be provided, the heat storage layer may be formed on either an inner side or an outer side of the elastic layer.

The heat storage layer may be formed using a silicone rubber composed of a metallic oxide powder such as silica, alumina, or magnesium oxide as a filler to raise thermal conductivity, aluminium, copper, or nickel, and forming these materials into a tube shape and coating, or plating them. The heat storage layer may employ materials with elasticity such as a silicone rubber. When the layer is formed of metal, however, and formed too thick, the hardness of the belt may increase and the nip quantity necessary to melt a toner may not be provided. Therefore, for example, the thickness of the heat storage layer may be preferably 10 to 1000 μm, and further preferably 50 to 500 μm.

Also, the heating belt 21 has a width in a width direction (a direction perpendicular to the page in FIG. 2) smaller than a width of the induction heating portion 25 and larger than a width of a maximum paper passing through the fixing nip portion N. This may enable the induction heating portion 25 to heat the whole heating belt 21 uniformly to suppress a fixing unevenness and may enable the heating belt 21 to cover an entire paper surface regardless of paper size, suppressing adhesion of unfixed toners onto the fixing roller 22.

In one exemplary embodiment, the heating belt 21 may be formed by laminating a silicone rubber layer (the elastic layer) in a thickness of 0.3 mm on a nickel layer (the induction heating layer 21*a*) having a thickness of 0.035 mm, and covering the silicone rubber layer with a PFA tube (the release layer 21*b*) having a thickness of 30 μm to a belt having an outer diameter of 40 mm and a width of 340 mm.

Also, a thermistor (not shown) may be provided so that it contacts the surface of the heating belt 21. This thermistor detects temperature of the heating belt 21. Then, a current flowing through the induction heating portion 25 is switched on and off to control the fixing temperature.

The fixing roller 22 contacts the pressure roller 23 to form a fixing nip N through which the paper P passes. The fixing roller 22 may employ metal such as aluminum or a heat-resistant resin. A silicone rubber layer having a thickness of about 1 to 10 mm may be provided as an elastic layer on a contact surface with the heating belt 21 and a sheet made from PTFE (polytetrafluoroethylene) may be attached on the surface of the silicone rubber layer as a release layer.

The fixing roller 22 according to one exemplary embodiment may be formed by laminating a silicone rubber layer (the elastic layer) having a thickness of 9.5 mm on an outer circumferential surface of an aluminum pipe having an outside diameter of 20 mm, a length of 335 mm, and a thickness of 2 mm and then attaching the PTFE sheet (the release layer.)

The pressure roller 23 includes a core metal 23*a* and an elastic layer 23*b* provided outside of the core metal 23*a*. A pressure adjustment mechanism (not shown) may be provided on the core metal 23*a* to adjust pressure from the pressure roller 23, thereby providing a contact pressure at a predetermined pressure (for example, 300N) from the pressing roller 23 to the fixing roller 22. The pressure roller 23 is rotationally driven in the clockwise direction by a drive motor (not shown). The surface of the pressure roller 23 may be covered with release layers such as the PFA tube. The pressure roller 23 according to one exemplary embodiment may be formed by laminating the silicone rubber layer having a thickness of 3.5 mm as the elastic layer 23*b* outside the aluminum pipe having an outer diameter of 23 mm, a length of 337 mm, and a thickness of 3 mm as the metal core 23*a*, and coating a fluorine resin on the outer surface as the release layer.

The induction heating portion 25 heats the heating belt 21 with electromagnetic induction. The induction heating portion 25 may include a coil bobbin 27, an induction heating coil 29, and a core portion including arch cores 30*a* and side cores 30*b*. The induction heating portion 25 is arranged facing the heating belt 21 to surround a part of an outer arc surface of the heating belt 21.

The coil bobbin 27 is formed into an arc shape along the outer surface of the heating belt 21 in a sectional view. The coil bobbin 27 may preferably employ a heat-resistant resin (for example, PPS; polyphenylene sulfide resin, PET; polyethylene terephthalate resin, LCP; liquid crystal polymer resin).

On the coil bobbin 27, a winding core portion 31 extending in the longitudinal direction of the induction heating portion 25 (a direction perpendicular to the page in FIG. 2) is positioned and the induction heating coil 29 formed by a winding Litz wire 28 around the winding center portion 31 several times (in this embodiment, for example, ten times). The induction heating coil 29 includes a linear portion 29*a* extending in the longitudinal direction of the induction heating portion 25 and turn portions 29*b* located on both ends of the induction heating portion 25 and is connected to a power supply (not shown). The induction heating coil 29 may be fixed on the coil bobbin 27 using a heat-resistant adhesive (for example, silicone-based adhesive).

The Litz wire 28 may be formed by bundling and then twisting a plurality of thin wires (conductive wires), covering with an enamel layer, and then covering the outside of the enamel layer with a fusion layer. The number of the thin wires may be adjusted according to a voltage of the power supply connected to the Litz wire 28. For example, in the case of a voltage of 100 V, the Litz wire 28 bundled with one hundred and fifty thin wires to have a diameter of 3.3 mm may be used. And in the case of a voltage of 200V, the Litz wire 28 bundled seventy five thin wires to have a diameter of 1.7 to 1.8 mm may be used.

A plurality of arch cores 30*a* and a pair of side cores 30*b* are arranged to surround the induction heating coil 29. The arch cores 30*a* may be cores made from a ferrite and be formed into an arch shape in a sectional view. The side cores 30*b* arranged at both sides may be cores made from ferrite and be formed in a block shape. The side cores 30*b* are formed so as to connect both ends of each of arch cores 30*a*. Each of the side cores 30*b* covers outside of an area where the induction heating coil 29 is disposed, respectively.

The arch cores 30*a*, for example, may be provided at given intervals along the longitudinal direction of the induction heating portion 25. The higher the arrangement density of the arch cores 30*a* is, the better induction performance of the magnetic flux may be. The induction performance of the magnetic flux, however, may not be so lowered if the arrangement density of the arch cores is reduced. Therefore, the arrangement density may be preferably set so as to reach a high cost performance to the extent that enough performance can be provided. Additionally, a temperature distribution in the width direction of the heating belt 21 may be adjusted by adjusting the arrangement density of the arch cores 30*a*.

The side cores 30*b* are arranged along the longitudinal direction of the induction heating portion 25. The side cores 30*b* are so formed that each of the side cores has a length of about 30 to 60 mm. The plurality of side cores 30*b* are arranged consecutively without opening an interval in the longitudinal direction of the induction heating portion 25. This consecutive arrangement of the plurality of the side cores 30*b* may make a deflection amount of the temperature distribution caused by the arrangement of the arch cores 30*a* even. The arrangement of the arch cores 30*a* and the side cores 30*b* may be determined based on, for example, magnetic flux (magnetic field strength) distribution of the induction heating coil 29. For the arrangement of the arch cores 30*a* at given intervals, the side cores 30*b* supplement a focusing effect of the magnetic flux at the point where the arch cores 30*a* are not disposed, to make magnetic flux density distribution (temperature distribution) in the longitudinal direction even.

In this exemplary embodiment, the seven arch cores 30*a* having an arch shaped section as shown in FIG. 2 and having a width of 10 mm are arranged in the longitudinal direction of the induction heating portion 25 at predetermined intervals. And the four side cores 30*b* having a length of 42.5 mm, a width of 12 mm, and a thickness of 3.5 mm are arranged at both ends of the arch cores 30*a* in the longitudinal direction. The number of the arch cores 30*a* and the side cores 30*b* may be adjusted. In another exemplary embodiment, the number of the arch cores 30*a* and the side cores 30*b* may be thirteen and eight, respectively.

The induction heating portion 25 applies the induction heating coil 29 with a high frequency current to generate magnetic flux through the arch cores 30*a* and the side cores 30*b*. The magnetic flux generated from the induction heating portion 25 works on the induction heating layer 21*a* of the heating belt 21. As a result, an eddy current generates around magnetic flux from the induction heating layer 21*a*. Then Joule heat is generated by an electrical resistance of the induction heating layer 21*a* and therefore the heating belt 21 is heated.

The current flowing in the induction heating coil 29 is controlled so that the heating belt 21 can be a predetermined temperature with a thermistor. And the heating belt 21 is heated to the predetermined temperature with the induction heating portion 25, then the paper P conveyed in the fixing nip portion N (refer to FIG. 1) is heated and pressurized with the pressure roller 23 to fuse and fix the toner in the powder state on the paper P.

Figure 4:
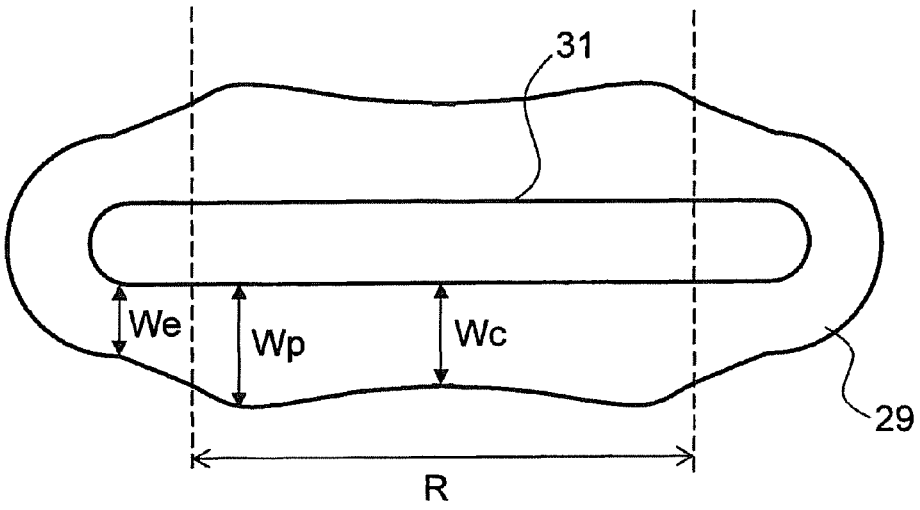
FIG. 4 is a schematic view of an induction heating coil employed in the fixing device according to one of the exemplary embodiments of the present disclosure.

FIG. 4 is a schematic plane view illustrating the induction heating coil 29. The Litz wire 28, which configures the induction heating coil 29, is omitted in FIG. 4. In this embodiment, a wound width of the induction heating coil 29 seen from the winding direction (that is, an axial direction) may be set so that the wound width is gradually enlarged from a central portion in the longitudinal direction (that is, the wound width Wc) to both ends. And a wound width Wp in the vicinity inside edges of a maximum paper passing region R of the recording medium (the paper P) is set to be a maximum (the maximum paper passing region R is also said as "maximum recording medium passing region R" hereinafter). Furthermore, the Litz wire 28 is so designed that the wound width is gradually reduced from the edges of the maximum paper passing width (that is, the maximum paper passing region) R to both edges of the induction heating coil in the longitudinal direction and a wound width We at the edges in the longitudinal direction is smaller or equal to the wound width Wc of the central portion in the longitudinal direction. That is, the relationship between the wound widths Wc, Wp, and We is described as the following formula (1).

$$We \leq Wc < Wp \quad (1)$$

A manufacturing method for induction heating coil 29 is described hereinafter. At first the Litz wire 28 is paid out from a reel (not shown) of the wound Litz wire 28 and is so arranged on the winding center portion 31 of the coil bobbin 27 that the starting end (that is, the starting end in winding) of the wire projects from the coil bobbin 27. Then, the Litz wire 28 is wound to the winding center portion 31*a* predetermined number of turns (for example, ten turns), while a predetermined tension is applied to the Litz wire 28.

Figure 5:
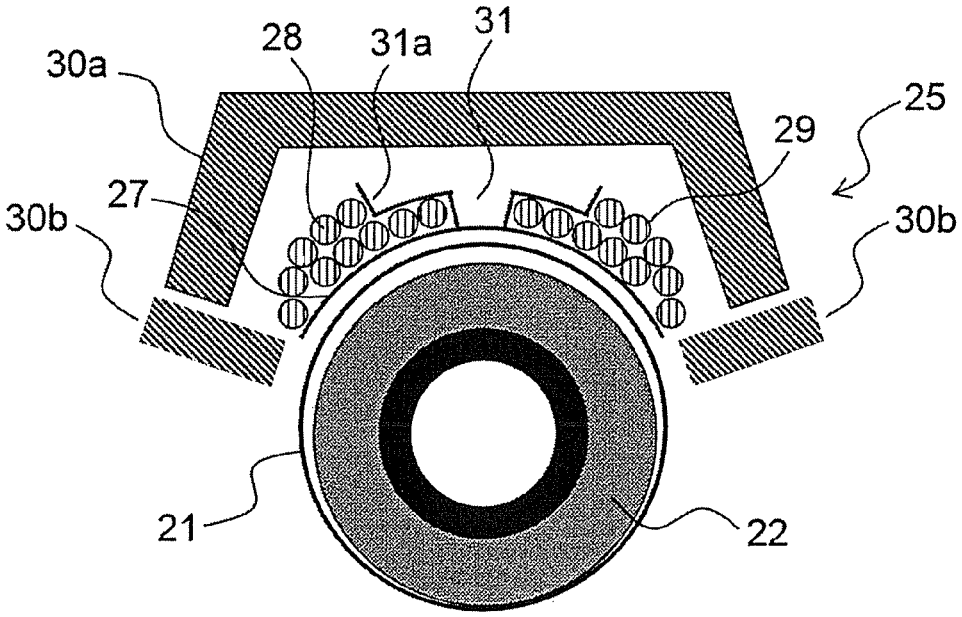
FIG. 5 is a side sectional view of portions corresponding to a wound width Wp of an induction heating coil of an induction heating belt, a fixing roller, and an induction heating portion included in the fixing device according to one of the exemplary embodiments of the present disclosure.
Figure 6:
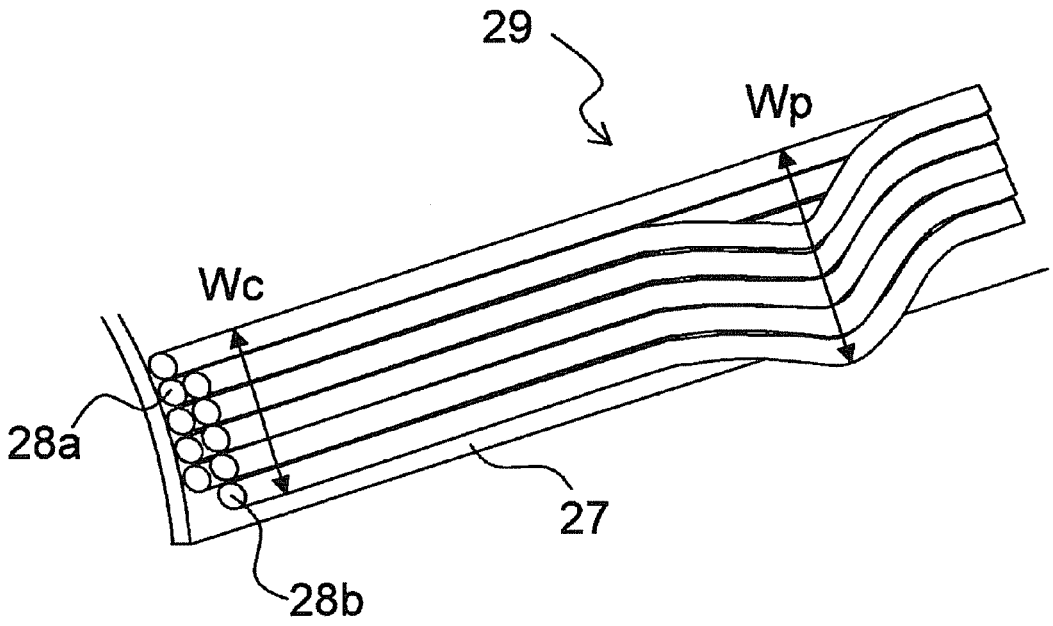
FIG. 6 is a partial perspective view illustrating a wound state of a Litz wire 28 at a portion corresponding to a wound width Wp of the induction heating coil.

FIG. 5 is a side sectional view of portions corresponding to a wound width Wp of the induction heating coil 29 of the induction heating belt 21, the fixing roller 22, and the induction heating portion 25 (that is, sectional view taken along arrows BB' in FIG. 3). And FIG. 6 is a partial perspective view illustrating a wound state of the Litz wire 28 at a portion corresponding to the wound width Wp of the induction heating coil 29. As shown in FIGS. 2 and 5, a step portion 31*a* is formed at a portion opposite to edges of the maximum paper passing region R in the winding center portion 31. Thus, in a region of the induction heating coil 29 between the central portion in the longitudinal direction and the ends in the maximum paper passing region R, the Litz wire 28 is disposed in two different steps seen from a width direction of the induction heating coil 29 (that is, the recording medium conveying direction).

In this configuration, the step portion 31*a* formed in the vicinity inside edges of the maximum paper passing region R in the winding center portion 31 (refer to FIG. 5) is set to be larger than the step portion 31*a* formed at the central portion in the longitudinal direction of the winding center portion 31 (refer to FIG. 2). Therefore, as illustrated in FIG. 6, a Litz wire 28*a* at a first step of the above two steps formed in the winding center portion 31 and in contact with a surface of the coil bobbin 27 is wound in a linear shape along the longitudinal direction. While a Litz wire 28*b* at a second step overlapped on the Litz wire 28*a* at the first step is so wound in such a shape bending toward the outside in a circumferential direction that a gap amount (that is, a difference from the Litz wire 28*a* at the first step) is gradually enlarged from the central portion side in the longitudinal direction (left side in FIG. 6) to the vicinity area inside edges of the maximum paper passing region R (right side in FIG. 6). Thereby, the wound width Wp of the induction heating coil 29 is set to be larger than the wound width Wc.

Figure 7:
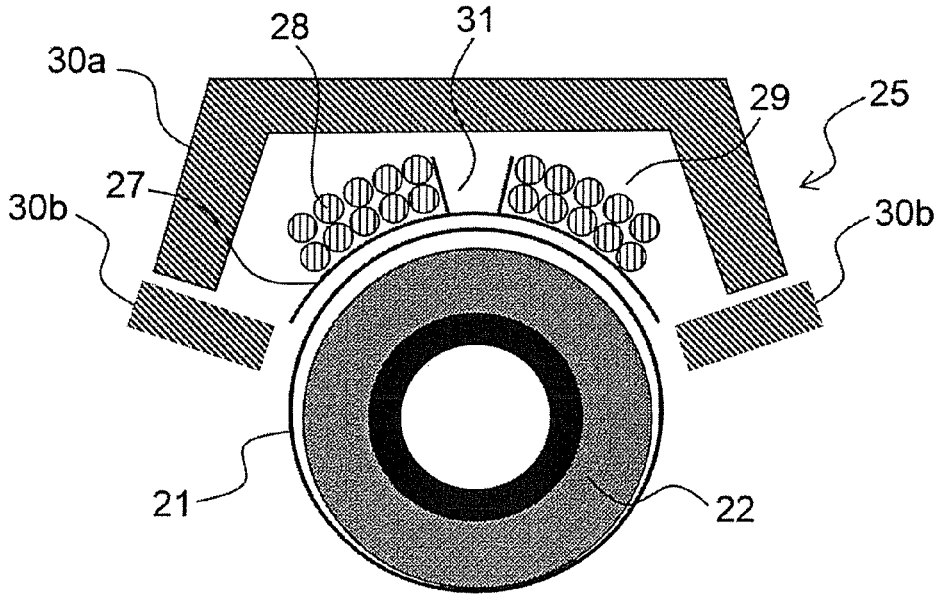
FIG. 7 is a side sectional view of portions corresponding to the wound width We of the induction heating coil of the induction heating belt, the fixing roller, and the induction heating portion included in the fixing device according to one of the exemplary embodiments of the present disclosure.

FIG. 7 is a side sectional view of portions corresponding to the wound width We of the induction heating coil 29 of the induction heating belt 21, the fixing roller 22, and the induction heating portion 25 (that is, sectional view taken along arrows CC' in FIG. 3). As shown in FIG. 7, in the winding center portion 31, the step portion 31*a* is not formed in the region between the edges of the maximum paper passing region R and the edges in the longitudinal direction. Therefore, the Litz wire 28 is wound without a gap seen from a width direction (that is, the width direction of the Litz wire 28, in other words, the circumferential direction of the fixing roller 22). Thereby, the wound width We at the edges in the longitudinal direction of the induction heating coil 29 gets smaller than the wound width Wc and Wp. As described above, in this embodiment, the Litz wire 28 is wound to overlap without gap at the ends in the longitudinal direction of the induction heating coil 29. The winding way may not be limited to this and the Litz wire 28 may be wound so that a gap may be formed at the ends as long as the relationship that the wound width We is smaller than or equal to the wound width Wc and smaller than the wound width Wp is satisfied.

According to above mentioned way, the Litz wire 28 is wound along the already wound Litz wire 28, to line sequentially from inside to outside in the radial direction of the winding center portion 31. Thereby, the induction heating coil 29 is formed in an arc shape in a sectional view arranged on the coil bobbin 27. And an end portion in the reel side of the Litz wire 28 is cut, while the rolled up induction heating coil 29 is maintained so as not to become loose, so that the Litz wire 28 protrudes at a predetermined length. This enables both ends of the Litz wire 28, that is, a winding starting side end and a winding ending side end, to protrude from the coil bobbin 27. Terminals may be attached to both ends of the Litz wire 28.

In this state, an electric current may be applied to the induction heating coil 29 through the terminals attached to both ends of the Litz wire 28 and thereby the Litz wire 28 is self-heated and a fusing layer on the surface is melted. And after a given time, an application of an electric current is interrupted to cool down the induction heating coil 29. This fixes the fusing layer again to fix the shape of the induction heating coil 29.

An area of the induction heating coil 29 opposing to the heating belt 21 may be increased by an increase in the wound width of the induction heating coil 29. Therefore, an area that the magnetic flux generated by the induction heating coil 29 passes can be increased. Thereby, the heat generation amount in the heating belt 21 may be increased. In this embodiment, the maximization of the wound width Wp of the heating coil 29 in the vicinity inside edges of a maximum paper passing region R enables the heat generation amount in the paper passing region to increase, while reduction of the wound width toward the end portions in the longitudinal direction enables the heat generation amount in the non-paper passing region to decrease.

Therefore, while a whole area within the maximum paper passing region R of the heating belt 21 is effectively heated and uniform heat generation distribution may be provided, heat generation in the non-paper passing region may be suppressed, so that unevenness in the fixing temperature or energy loss can be effectively reduced. Also, the damage of the width direction ends of the heating belt 21, which are easy to be damaged due to an excessive heat generation can be suppressed. Therefore, this also may contribute to an extension of the usable life of the heating belt 21. Furthermore, because it is not necessary to provide a core portion (a center core) in the vicinity of both ends of the induction heating coil 29, a configuration of the induction heating portion 25 may be simplified and cost for the induction heating portion 25 may be reduced.

As described above, for example, one proposed induction heating device is designed so that a distance between a magnetizing coil and a fixing film as the heating member is closer in both end portions in the width direction of the fixing film than the distance in a center portion, to increase an amount of heat generation in both end portions in the width direction of the fixing film. And, for example, another proposed fixing device employing the induction heating system is so designed that a cross section of a core member, on which a magnetizing coil is wound, broadens from the center portion to both end portions in the longitudinal direction of the heating roller, to increase the interval of the magnetizing coil from the center portion to both end portions in the longitudinal direction of the heating roller.

In these systems, a reduction in the magnetic flux at the ends in the longitudinal direction may be suppressed and a heat generation amount at both end portions of the heating member in a direction perpendicular to the paper conveying direction may be increased. This may be expected to suppress a temperature drop. However, in such fixing devices, the heat generation amount outside the maximum paper passing region of the heating member may be increased. This may result in energy loss. Furthermore, at both end portions of the heating member in a direction perpendicular to the paper conveying direction, which oppose turn portions in the induction heating coil, magnetic flux generated in the turn portions may penetrate, to increase a heat generation amount locally. This may cause the heating member to be damaged due to an excessive temperature rise.

In an exemplary embodiment of the present disclosure, the induction heating coil is wound so that the wound width is gradually enlarged from the wound width Wc at the central portion in the longitudinal direction and reaches a maximum width at the wound width Wp in the vicinity inside the edges in the maximum paper passing region, and the wound width We at both ends in the longitudinal direction is set to be less than or equal to the wound width Wc. This may maintain a surface temperature of the heating member substantially uniform over the whole paper passing region. The unnecessary heat generation in the non-paper passing region of the heating member may also be suppressed. Therefore, the fixing device may be provided which can maintain a good fixing performance regardless of the size of the recording medium. Also, in the fixing device according to exemplary embodiment of the present disclosure, an energy loss or damage in the heating member due to an excess heat generation may be suppressed.

That is, according to the exemplary embodiment of this disclosure, the fixing device employing an induction heating system may be provided which can suppress the unevenness of the amount of heat generation in the whole paper passing region and maintain a uniform heat generation amount. Also, the fixing device employing the induction heating system can suppress heat generation in the non-paper passing region of the recording medium.

Further, in an exemplary embodiment of this disclosure, the wound width We at both ends in the longitudinal direction of the induction heating coil 29 is set to be smaller than the wound width Wc at the central portion in the longitudinal direction. This may further suppress the heat generation in the non-paper passing region.

As described above, in the exemplary embodiment of this invention, the Litz wire 28 may be formed in a shape bending outwards in the circumferential direction of the heating roller, so that the wound width Wc of the central portion in the longitudinal direction is smaller than the wound width Wp, that is, the wound width of the induction heating coil 29 in the vicinity of and inside the edge of the maximum recording medium passing region and is larger than or equal to the wound width We, that is, the wound width of the edge of the induction heating coil 29 in the longitudinal direction. Thus, the bending portion of the Litz wire 28 may be formed in the vicinity of and inside the edge of the maximum recording medium passing region. In the exemplary embodiment of this disclosure, as described in examples indicated later, the Litz wire 28 may be formed in a shape bending outwards in the circumferential direction of the heating roller so that a bending portion of the Litz wire 28 may be disposed inside the maximum paper passing width (that is, the central portion side in the longitudinal direction) by 30 mm.

From the view point of suppressing a surface temperature drop at both ends in the longitudinal direction and maintaining the surface temperature in the whole paper passing region of the recording medium more uniform, for example, the Litz wire 28 may be preferably wound so that the bending portion may be disposed in the areas which the surface temperature drop may occur in both end portions in the longitudinal direction in a fixing device described later as in a comparative example 1 referring to FIG. 8 (illustrated with a broken line in FIG. 8), in which the wound widths Wc, Wp, and We in the induction heating coil are set to be same length (that is, the wound width is set to be constant in the longitudinal direction.)

Therefore, the Litz wire 28 may be preferably wound so that the bending portion may be provided inside the maximum paper passing width by equal to or more than 20 mm and equal to or less than 40 mm in the longitudinal direction. Also, the Litz wire 28 may be preferably wound so that the bending portion may be provided at the position apart from the central portion in the longitudinal direction by equal to or more than 0.70 times and equal to or less than 0.90 times of the distance between the central portion in the longitudinal direction to the maximum paper passing width (that is, the end portions in the maximum paper passing region). Furthermore, the bending portion may be further preferably provided at the position apart from the central portion in the longitudinal direction by equal to or more than 0.75 times and equal to or less than 0.85 times of the distance between the central portion in the longitudinal direction to the maximum paper passing width. The surface temperature drop at both end portions in the longitudinal direction may be effectively suppressed by providing the bending portion as described above.

Embodiments according the present disclosure may not be limited to the above described embodiments and various kinds of changes may be possibly employed without departing from a purpose of the configuration according to the embodiment of this disclosure. For example, configurations of the heating belt 21 and pressure roller 23 in the above embodiment are illustrated as examples and other configurations may be adopted which can achieve the object of the embodiment according to this disclosure. Also, in the above embodiment, the fixing device 13 employing a belt fixing system is illustrated in which the induction heating layer 21*a* of the heating belt 21 may be heated with the induction heating portion 25. The above exemplary embodiment according to the present disclosure may be employed in a fixing device employing a heat roller fixing system in which a heating roller including the induction heating layer 21*a* is provided instead of the heating belt 21 in the same manner.

Also, the fixing device 13 including the induction heating portion 25 according to the exemplary embodiment of this disclosure may be employed in, other than the tandem-type color printer shown in FIG. 1, various types of image forming apparatuses using electrophotographic processes such as a digital multi-functional peripheral, a color copier, a monochrome copier with an analogues formula, a monochrome printer, or a facsimile machine. The effect of the embodiment according to this disclosure is further described with examples in detail as follows.

EXAMPLE 1

Using the fixing device 13 employing the belt fixing system illustrated in FIG. 2, the temperature distribution in the width direction of the heating belt 21 was measured. The step portion 31*a* was formed in the winding center portion 31 of the coil bobbin 27 and the Litz wire 28*b* was formed in a bending shape such that the Litz wire 28*b* (FIG. 6) was bent toward the outside in the circumferential direction between the central portion in the longitudinal direction to the position distanced from the central portion by 150 mm (that is, the maximum paper passing width). In this manner, the fixing device of Example 1 provided with the induction heating portion 25 was obtained. The Litz wire 28*b* was so disposed that a top portion of the bending portion was away from the central portion in the longitudinal direction by 120 mm. The wound width of the induction heating coil 29 was set so that the wound width Wc at the central portion in the longitudinal direction was set to be 15 mm, the wound width Wp at the top portion of the bending portion (in the vicinity inside the maximum paper passing width) was set to be 19 mm, and the wound width We at 160 mm apart from the central portion in the longitudinal direction was set to be 14 mm. Also, the width between inner surfaces of the turn portions 29*b* (refer to FIG. 3) of the induction heating coil 29 was set to be 330 mm, the width between inner surfaces in the linear portions 29*a* (refer to FIG. 3) was set to be 10 mm.

And a fixing device as a Comparative Example 1 was not provided with the step portion 31*a* in the winding center portion 31 of the coil bobbin 27 and therefore in the fixing device of the Comparative Example 1, all of the wound widths Wc, Wp, and We were set to be 15 mm. And a fixing device as a Comparative Example 2 was so designed that magnetic body cores (center cores) disposed at both ends of the induction heating coil 29. Then the surface temperature distribution in the width direction of the heating belt 21 was measured for the Present Example 1, the Comparative Example 1, and the Comparative Example 2, while an electric current were applied to the induction heating coil 29 of these fixing devices. The results are shown in FIG. 8.

Figure 8:
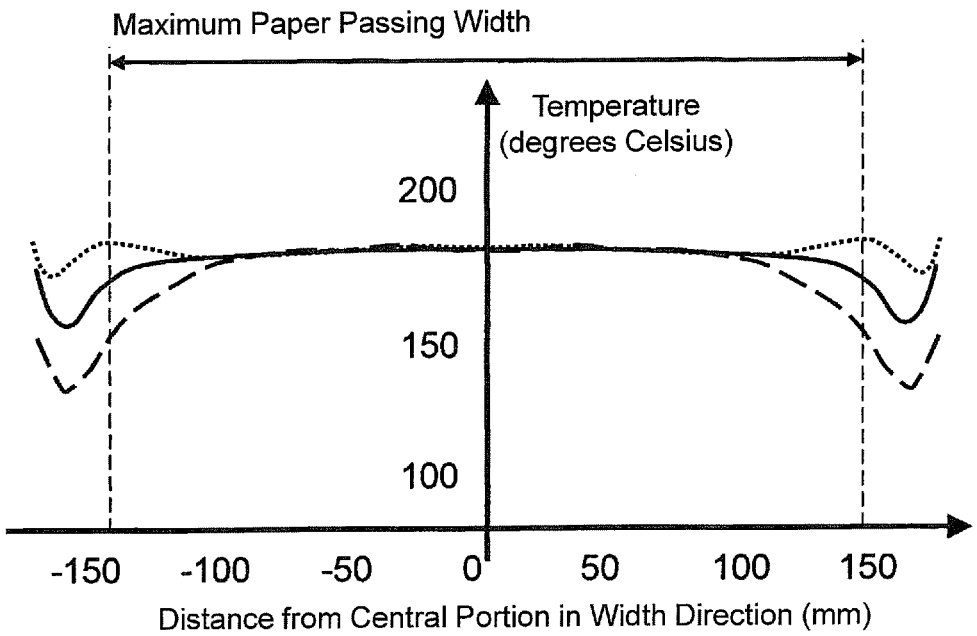
FIG. 8 is a graph showing a surface temperature distribution along the width direction of the induction heating belt in an Example 1.

As is clear from FIG. 8, in the present example 1, in which the wound width of the induction heating coil 29 was enlarged gradually from the central portion in the longitudinal direction (that is, the wound width Wc) to the vicinity area inside the maximum paper passing width, the wound width reached a maximum value in the vicinity area (that is, the wound width Wp), and the wound width We at both ends in the longitudinal direction was set to be smaller than the wound width Wc, as shown with a solid line in FIG. 8, a surface temperature of the heating belt 21 was maintained at about 180 degrees Celsius and therefore the surface temperature was maintained substantially uniform over the whole paper passing region. Also, the surface temperature outside the maximum paper passing width of the heating belt 21 fell to around 160 degrees Celsius. As a result, the unnecessary heat generation in the non-paper passing region was suppressed.

In contrast, in the fixing device according to the Comparative Example 1, in which the wound width of the induction heating coil 29 was set to be constant in the longitudinal direction, as shown with a broken line in FIG. 8), the surface temperature of the heating belt 21 at both end portions in the maximum paper passing width fell to about 160 degrees Celsius. This might cause a fixing defective. Also, in the fixing device according to the Comparative Example 2, configured in the same manner as the fixing device according to the Comparative Example 1 except that the magnetic cores were added at both ends in the longitudinal direction, as shown with a dotted line in FIG. 8, although the surface temperature of the heating belt 21 was maintained at about 185 degrees Celsius, the surface temperature was maintained high, at around 180 degrees Celsius outside the maximum paper passing width. That is, unnecessary heat generation occurred in the non-paper passing region.

EXAMPLE 2

Using the fixing device 13 employing a belt fixing formula shown in FIG. 2, the heat generation amount at the ends in the width direction of the heating belt 21 was measured. The fixing device of the Present Example 2 was so designed that the step portion 31*a* was formed in the winding center portion 31 of the coil bobbin 27 and in the induction heating coil 29, the wound width Wc of the central portion in the longitudinal direction was set to be 16 mm, the wound width Wp in the vicinity of the top portion in the bending portion (the top portion was provided in the area apart from the central portion by 135 mm to 145 mm) was set to be 20 mm, and the wound width We apart from the central portion in the longitudinal direction by 160 mm (both ends in the longitudinal direction) was set to be 16 mm. And the heat generation amounts at both ends in the width direction of the heating belt 21 were measured while an electric current was applied.

Figure 9:
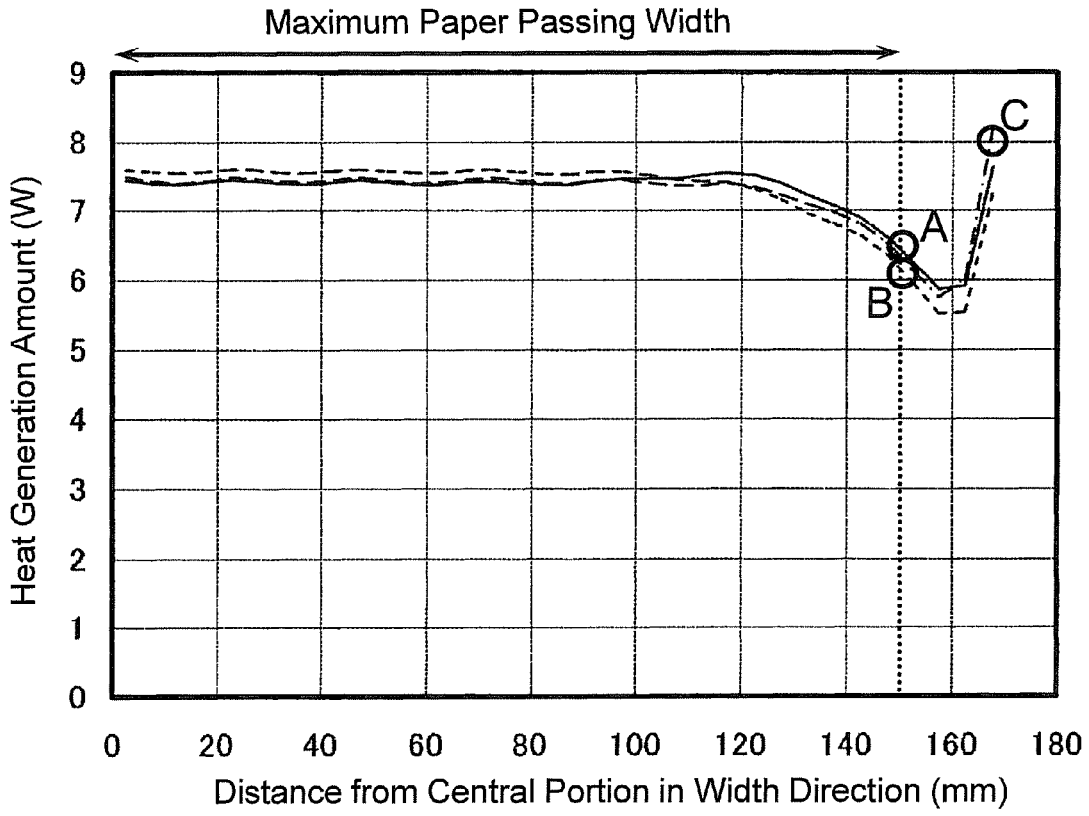
FIG. 9 is a graph showing an amount of heat generation from a center portion in the width direction to an end portion of the induction heating belt in an Example 2.

The heat generation amounts at the end portions in the width direction were measured also for the fixing device according to the Comparative Example 1, in which all of the wound widths Wc, Wp, and We were set to be 15 mm, and a fixing device according to a Comparative Example 3, in which the wound width We of the induction heating coil 29, from the maximum paper passing width (that is, the points away from the central portion in the longitudinal direction by 150 mm) to the both end portions in the longitudinal direction was set to be 19 mm. The results are illustrated in FIG. 9. Although in FIG. 9, the heat generation amount of the heating belt 21 is illustrated for the heat generation amount from the central portion to one side end in the width direction, the same behavior was shown for the heat generation amount from the central portion to the other side end.

In the Present Example 2, in which the wound width of the induction heating coil 29 was enlarged gradually from the central portion in the longitudinal direction (that is, the wound width Wc) to the vicinity area inside the maximum paper passing width, the wound width reached a maximum value in the vicinity area (that is, the wound width Wp), and the wound width We at both ends in the longitudinal direction was set to be smaller than the wound width Wc, as shown with a solid line in FIG. 9, the heat generation amount was maintained at about 6.5 W (see circle A) even at both ends in the maximum paper passing width. That is, the heat generation amount was maintained at 6.5 to 7.5 W over the whole paper passing region (that is, inside the maximum paper passing width). Also, the heat generation amount at the ends in the width direction in the heating belt 21 (that is, outside the maximum paper passing width) was suppressed to 7.6 W. Therefore, the unnecessary heat generation in the non-paper passing region was also suppressed.

In contrast, in fixing device according to the Comparative Example 1, in which the wound width of the induction heating coil 29 was set to be constant in the longitudinal direction, as shown with a broken line in FIG. 9, the heat generation amount of the heating belt 21 at the both end portions in the maximum paper passing width fell to about 6 W (see circle B). Also, in fixing device according to the Comparative Example 3, in which the wound width We at both end portions in the longitudinal direction was set to be larger, as shown with an alternate long and short dash line in FIG. 9, although the heat generation amount was maintained at larger than or equal to 6.5 W, the heat generation amount at both ends in the width direction of the heating belt 21 (that is, outside the maximum paper passing width) was high, at 8 W (see circle C). That is, the unnecessary heat generation was generated in the non-paper passing region. Also, width direction ends of the heating belt 21 might be damaged due to the generated heat.

The exemplary embodiment according to this disclosure may be employed as the fixing device using the induction heating system with the induction heating portion. Employing the exemplary embodiments according to this disclosure may provide a fixing device which enables the surface temperature of the heating member to be maintained substantially uniform, and to maintain a fixing performance. Also, employing the exemplary embodiments according to this disclosure may provide a fixing device which can suppress unnecessary heat generation of the heating member in the non-paper passing region, thereby reducing an energy loss.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A fixing device to fix an image on a recording medium, comprising: a heating member having an induction heating layer; a pressing member configured to contact the heating member and to form a nip portion with the heating member through which the recording medium with the image is to pass; and an induction heating unit comprising an induction heating coil and arranged along an outer circumferential surface of the heating member, the induction heating unit applying an electric current to the induction heating coil to generate a magnetic flux to heat the induction heating layer of the heating member; wherein the induction heating unit comprises a coil bobbin provided with a winding center portion on which a Litz wire is wound a plural number of laps; wherein the wound width of the induction heating coil is changed by winding the Litz wire along a step portion formed on the winding center portion; and wherein (i) a wound width We of a center portion of the induction heating coil in a longitudinal direction seen from an axial direction of the heating member, (ii) a wound width Wp in a vicinity of and inside edges of a maximum recording medium passing region of the recording medium, and (iii) a wound width We of at least one of both edges of the induction heating coil in the longitudinal direction satisfy parameters that the wound width Wc is smaller than the wound width Wp and is larger than or equal to the wound width We; wherein the wound width We of at least one of both edges in the longitudinal direction is smaller than the wound width Wc of the center portion in the longitudinal direction.

2. The fixing device according to claim 1, wherein the heating member is an endless heating belt.

3. The fixing device according to claim 1, wherein, a wound width of the induction heating coil steadily increases from Wc to Wp in the longitudinal direction in directions of both edges of the induction heating coil.

4. The fixing device according to claim 1, wherein the wound width We of both edges of the induction heating coil in the longitudinal direction satisfy parameters that the wound width Wc is smaller than the wound width Wp and is larger than or equal to the wound width We.

5. The fixing device according to claim 1, wherein a bending portion of the Litz wire is at a distance from a central portion in the longitudinal direction of the induction heating coil in a range equal to or greater than 0.70 times and equal to or less than 0.90 times a distance from the central portion to the maximum recording medium passing region width.

6. The fixing device according to claim 5, wherein the bending portion of the Litz wire is at a distance from the central portion in the longitudinal direction of the induction heating coil in a range equal to or greater than 0.75 times and equal to or less than 0.85 times a distance from the central portion to the maximum recording medium passing region width.

7. A fixing device to fix an image on a recording medium, comprising: a heating member having an induction heating layer; a pressing member configured to contact the heating member and to form a nip portion with the heating member through which the recording medium with the image is to pass; and an induction heating unit comprising an induction heating coil and arranged along an outer circumferential surface of the heating member, the induction heating unit applying an electric current to the induction heating coil to generate a magnetic flux to heat the induction heating layer of the heating member; wherein the induction heating unit comprises a coil bobbin provided with a winding center portion on which a Litz wire is wound a plural number of laps; wherein the wound width of the induction heating coil is changed by winding the Litz wire along a step portion formed on the winding center portion; and wherein (i) a wound width We of a center portion of the induction heating coil in a longitudinal direction seen from an axial direction of the heating member, (ii) a wound width Wp in a vicinity of and inside edges of a maximum recording medium passing region of the recording medium, and (iii) a wound width We of at least one of both edges of the induction heating coil in the longitudinal direction satisfy parameters that the wound width We is smaller than the wound width Wp and is larger than or equal to the wound width We; wherein the step portion of the coil bobbin comprises first and second steps of different heights.

8. The fixing device according to claim 7, wherein the step portion of the coil bobbin is so formed that a step difference of the center portion in the longitudinal direction is smaller than a step difference in the vicinity of and inside the edges of the maximum recording medium passing region of the recording medium and is larger than or equal to a step difference of both edges in the longitudinal direction.

9. The fixing device according to claim 8, wherein the Litz wire wound along the step portion comprising the first and second steps so that the wound width Wc of the center portion in the longitudinal direction is smaller than the wound width Wp in the vicinity of and inside the edges of the maximum recording medium passing region of the recording medium and is larger than or equal to the wound width We of both edges in the longitudinal direction, to differ in position along a width direction of the wound Litz wire.

10. An image forming apparatus to execute an image formation on a recording medium comprising: an image forming unit to form an image on the recording medium; and a fixing device comprising: a heating member having an induction heating layer; and a pressing member configured to contact the heating member and to form a nip portion with the heating member through which the recording medium with the image is to pass; and an induction heating unit comprising an induction heating coil and arranged along an outer circumferential surface of the heating member, the induction heating unit applying an electric current to the induction heating coil to generate a magnetic flux to heat the induction heating layer provided of the heating member; wherein the induction heating coil comprises a coil bobbin provided with a winding center portion on which a Litz wire is wound a plural number of laps; wherein the wound width of the induction heating coil is changed by winding the Litz wire along a step portion formed on the winding center portion; and wherein (i) a wound width We of a center portion of the induction heating coil in a longitudinal direction seen from an axial direction of the heating member, (ii) a wound width Wp in a vicinity of and inside edges of a maximum recording medium passing region of the recording medium, and (iii) a wound width We of at least one of both edges of the induction heating coil in the longitudinal direction satisfy parameters that the wound width Wc is smaller than the wound width Wp and is larger than or equal to the wound width We; wherein the wound width We of at least one of both edges in the longitudinal direction is smaller than the wound width Wc of the center portion in the longitudinal direction.

11. The image forming apparatus according to claim 10, wherein the step portion of the coil bobbin comprises first and second steps of different heights.

12. The image forming apparatus according to claim 11, wherein the step portion of the coil bobbin is so formed that a step difference of the center portion in the longitudinal direction is smaller than a step difference in the vicinity of and inside the edges of the maximum recording medium passing region of the recording medium and is larger than or equal to a step difference of both edges in the longitudinal direction.

13. The image forming apparatus according to claim 12, wherein the Litz wire wound along the step portion comprising the first and second steps so that the wound width We of the center portion in the longitudinal direction is smaller than the wound width Wp in the vicinity of and inside the edges of the maximum recording medium passing region of the recoding medium and is larger than or equal to the wound width We of both edges in the longitudinal direction, to differ in position along a width direction of the wound Litz wire.

14. The image forming apparatus according to claim 10, wherein the heating member is an endless heating belt.

* * * * *